United States Patent [19]

Pawley

[11] 4,188,127

[45] Feb. 12, 1980

[54] MIXING BLADES OF CONCRETE MIXING DRUMS

[75] Inventor: Jess W. Pawley, London, Canada

[73] Assignee: London Concrete Machinery Co., London, Canada

[21] Appl. No.: 957,868

[22] Filed: Nov. 6, 1978

[51] Int. Cl.[2] ..... B28C 5/20

[52] U.S. Cl. ..... 366/44; 366/54; 29/156.8 B

[58] Field of Search ..... 366/42–46, 366/54, 336–339; 29/156.8 R, 156.8 B, 156.8 T, 23.5

[56] References Cited

U.S. PATENT DOCUMENTS

| | | | |
|---|---|---|---|
| 2,805,053 | 9/1957 | Smith | 366/44 |
| 3,038,705 | 6/1962 | McDermott | 366/44 |
| 3,198,495 | 8/1965 | Maxon, Jr. | 366/46 |
| 3,429,561 | 2/1969 | Maxon, Jr. | 366/45 |

*Primary Examiner*—Leonard D. Christian
*Attorney, Agent, or Firm*—Fetherstonhaugh & Co.

[57] ABSTRACT

A rotary concrete mixing drum which has a throat area leading to a mixing chamber is provided with a mixing blade which includes a leg portion projecting inwardly from the inner wall thereof and a discharge lip portion and a mixing lip portion. The mixing lip portion projects laterally from the leg portion toward the head end of the mixing chamber and does not extend into the charging throat area. The absence of a mixing lip in the throat area prevents a build up of concrete in the throat area. To facilitate the mounting of the mixing blade, an L-shaped blade segment is first mounted in the mixing drum and thereafter a discharge lip is connected to the L-shaped blade.

4 Claims, 3 Drawing Figures

MIXING BLADES OF CONCRETE MIXING DRUMS

FIELD OF INVENTION

Figure 2:
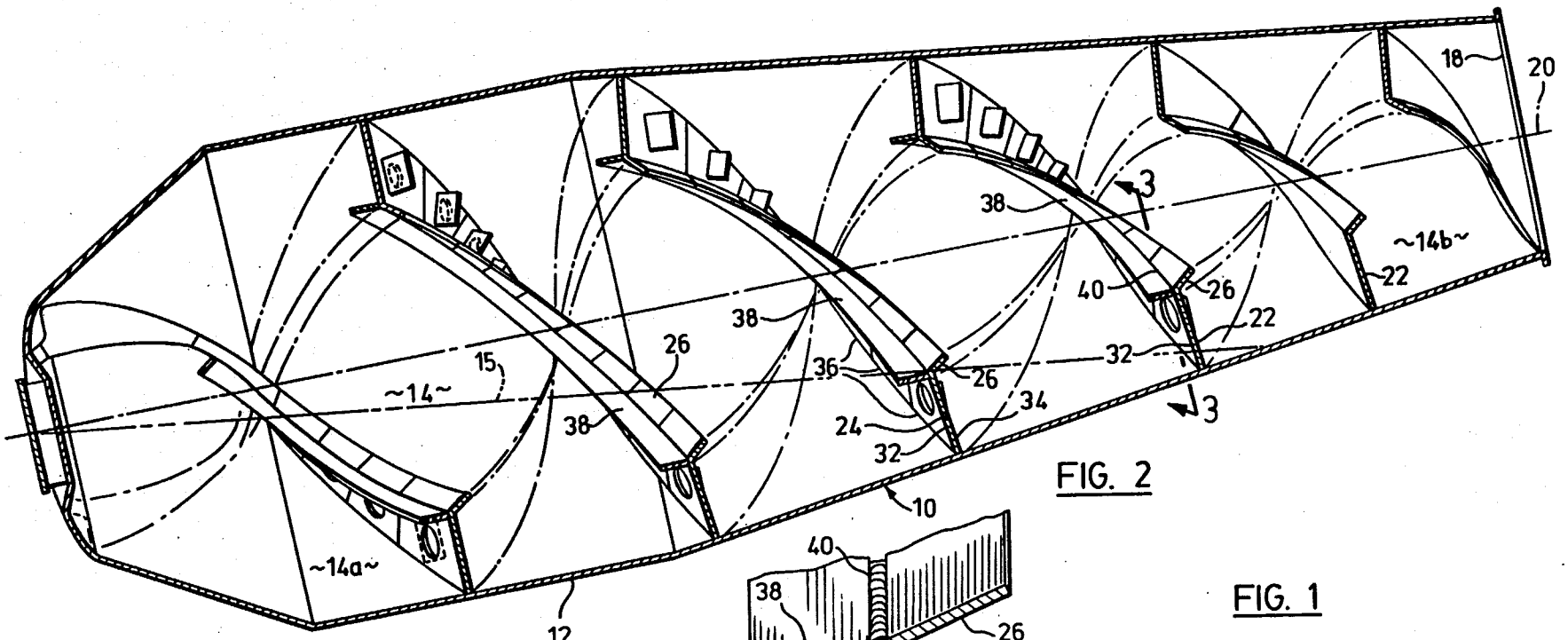

This invention relates to improvements in rotary concrete mixing drums. In particular this invention relates to improvements in the mixing blades of a rotary concrete mixing drum.

PRIOR ART

In the construction industry it is important to minimize the amount of time required in order to thoroughly mix concrete in a mixing drum. In a transit mixer, it is frequently necessary to add water to the concrete mixture at a job site in order to provide concrete in a consistency which is somewhat different to that originally charged into the mixing drum. Thus, it is important to ensure that a rapid mixing of water with concrete can be achieved in the mixing drum. It is also important to ensure that during the charging operation, concrete is transmitted away from the charging throat into the mixing section as quickly as possible. I have previously used a prefabricated T-shaped blade in an attempt to obtain an efficient rapid mixing. The T-shaped blades which have been previously used were prefabricated and considerable difficulty was experienced in attempting to weld these blades in position in a mixing drum. Furthermore, I found that there was a distinct tendency for concrete to accumulate behind the mixing lip of the T-shaped blade. This concrete tended to build up and set so that the efficiency of the mixing blade was progressively decreased. This problem is particularly accute in the throat area of the mixing drum where the proportions of the drum are so small as to make it extremely difficult to obtain access to the underside of the mixing blade in order to remove an accumulated build up.

I have now discovered that the advantages to be derived from the provision of a mixing lip can be obtained by limiting the extent of the mixing lip so that it extends in the mixing chamber only and does not extend in the throat area. I have overcome the difficulties previously encountered in attempting to mount the mixing blade by firstly locating an L-shaped blade in the housing and thereafter connecting the discharged lip to the L-shaped blade.

SUMMARY OF INVENTION

According to one aspect of the present invention there is provided in a rotary concrete drum having an inner wall defining a mixing chamber which includes a mixing section and a charging throat section, said drum having a head end and an open charging end arranged at opposite ends thereof, said drum being mounted for rotation about a mixing axis extending between said head end and said discharge end, said charging throat section extending inwardly from said charging end to said mixing section, mixing blade means mounted on and extending spirally along said inner wall from adjacent said charging end to adjacent said head end, said mixing blades having a mixing face directed toward said head end and the discharge face directed toward said charging end, the portion of the mixing face extending within the charging throat section being a charging face, the improvement wherein said mixing blade comprises; a leg portion projecting inwardly from said inner wall, a discharge lip portion projecting laterally from an inner end of said leg portion in a direction toward said charging end, said leg portion and said discharge portion being connected to one another before said leg portion is secured to said inner wall of said chamber, a mixing lip projecting laterally from said mixing face of said leg portion in a direction toward said head end, said mixing lip extending over at least a major portion of said mixing section inwardly from said charging throat section, said mixing lip being secured to said leg portion by welding thereto after said leg portion is secured to said inner wall of said chamber such that said mixing lip does not inhibit mounting of the leg portion within said chamber.

According to a further aspect of the present invention, there is provided a method of forming a mixing blade in a rotary concrete mixing drum having an inner wall defining a mixing chamber which includes a mixing section and a charging throat section, said chamber having a head end and an open discharge end disposed opposite one another comprising the steps of; preforming a plurality of mixing blade segments, each having a leg portion and a discharge lip portion projecting laterally from one end thereof, welding said leg portion of said mixing blade to the inner wall of said chamber with said mixing blade segments arranged in an end-to-end spiral configuration extending from adjacent said head end to adjacent said open discharge end with the discharge lip of each segment directed toward said discharge end, and thereafter welding the mixing lip to said one end of said leg portion, said mixing lip projecting laterally from said leg portion and extending along at a major portion of said mixing section of said mixing chamber.

Figure 1:
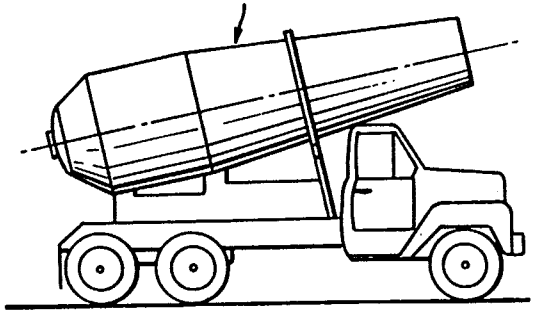
Figure 3:
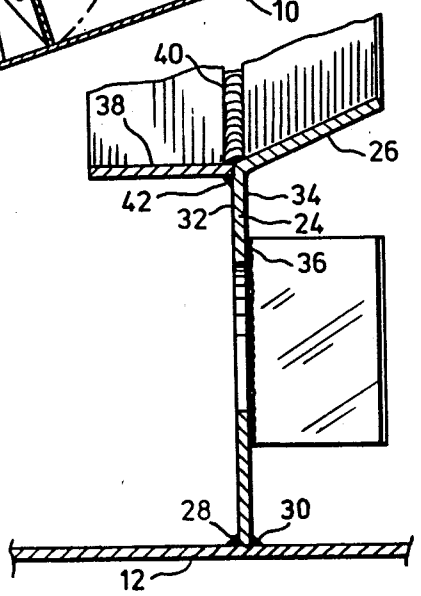

The invention will be more clearly understood after reference to the following detailed specification read in conjunction with the drawings wherein;

FIG. 1 is a side view of a transit mixer of the type in which the mixing blade of the present invention may be employed, FIG. 2 is a sectional side view taken perpendicularly through the mixing drum of FIG. 1 and FIG. 3 is a sectional view along the line 3—3 of FIG. 2.

With reference to the drawings, reference numeral 10 refers generally to a rotary concrete mixing drum which has a wall 12 defining a chamber 14. The chamber 14 has a head end 16 and an open discharge end 18 arranged opposite one another. The mixing drum 10 is mounted for rotation about an axis 20 which extends longitudinally between the head end 16 and the discharge opening 18. The chamber 14 includes a mixing section 14*a* and a throat section 14*b*. Throat section 14*b* extends from the front end of the full fill line 15 which represent the level to which the chamber 14 can be filled with concrete for transportation purposes. The throat section 14*b* decreases in diameter toward the discharge opening 18. Mixing blades 22 extend spirally of the inner wall of the chamber 14 from adjacent the discharge opening 18 to adjacent the head end 16. The mixing blades 22 each include a leg portion 24 and a discharge lip 26, the leg portion 24 is welded at its radially outer end along weld seams 28 and 30 to the wall 12 of the chamber 14. The leg portion 24 has a mixing face 32 directed toward the head end of the chamber and a discharge face 34 directed to the discharge end. The discharge lip 26 projects laterally from the inner end of the leg 26 in a direction toward the discharge end 18. It will be noted that the mixng blades 22 are formed in a plurality of sections 36 which are arranged in an end-to-end relationship and extend spirally along the inner wall of the mixing chamber 14. In each segment 36, the leg portion 24 and discharge lip 26 are integrally connected to one another, the lip 26 being formed by bending the panel from which the leg and lip are formed.

A mixing lip 38 is welded to the inner end of the leg portion 24 along weld seams 40 and 42 and projects laterally outwardly therefrom toward the head end of the mixing chamber. The mixing lip extends along the mixing blade from adjacent the charging section 14*a* over at least a major portion of the mixing section as shown in FIG. 2 of the drawings. It will be noted that the weld seam 40 is readily accessible from within the mixing chamber so that the mixing lip 38 can be easily secured to the mixing blade in situ. The mixing lip 38 does not extend into the throat section with the result that concrete does not accumulate on the charging face of the blades in the throat area.

In the manufacture of the mixing drum, a plurality of segments of mixing blade 38 are folded to a generally L-shaped configuration to provide the leg portion 24 and the mixing lip 26. The segments are located within the mixing drum and welded to the wall 12 along seam lines 28 and 30 in an end-to-end spiral configuration with the discharge lip 26 directed toward the discharge end 18. Thereafter, a length of flat stock steel is formed to a generally spiral configuration and the required shape of the mixing lip and is welded along weld seam 40 to the inner end of the leg 24 of the mixing blades 20 over a major portion of the length of the mixing section.

In use, when the rotary mixing drum is rotated in the mixing and charging directions, the mixing lip serves to drive the load of concrete inwardly toward the head end of the mixing section.

From the foregoing it will be apparent that the present invention provides a simple and inexpensive mechanism which serves to improve the speed with which a rotary concrete mixing drum can mix in addatives such as water or the like.

What I claim as my invention is:

1. In a rotary concrete mixing drum having an inner wall defining a mixing chamber which includes a mixing section and a charging throat section, said drum having a head end and an open charging end arranged at opposite ends thereof, said drum being mounted for rotation about a mixing axis extending between said head end and said discharge end, said charging throat section extending inwardly from said charging end to said mixing section, mixing blade means mounted on and extending spirally along said inner wall from adjacent said charging end to adjacent said head end, said mixing blades having a mixing face directed toward said head end and the discharge face directed toward said charging end, the portion of the mixing face extending within the charging throat section being a charging face, the improvement wherein said mixing blade comprises;

(a) a leg portion projecting inwardly from said inner wall, (b) a discharge lip portion projecting laterally from an inner end of said leg portion in a direction toward said charging end, said leg portion and said discharge portion being connected to one another before said leg portion is secured to said inner wall of said chamber, (c) a mixing lip projecting laterally from said charging face of said leg portion in a direction toward said head end, said mixing lip extending over at least a major portion of said mixing section inwardly from said charging throat section, said mixing lip being secured to said leg portion by welding thereto after said leg portion is secured to said inner wall of said chamber such that said mixing lip does not inhibit mounting of the leg portion within said chamber.

2. A rotary concrete mixing drum as claimed in claim 1 wherein said leg portion, discharge lip and mixing lip are arranged in a generally Y-shaped configuration and said charging lip is secured to said leg portion by a welding seam extending along the radiall inwardly exposed intersection of said mixing lip and said discharging lip.

3. A rotary concrete mixing drum as claimed in claim 1 or claim 2 wherein said leg portion and said discharge lip of said mixing blade are formed from a unitary panel folded upon itself to a generally L-shaped configuration.

4. A method of forming a mixing blade in a rotary concrete mixing drum having an inner wall defining a mixing chamber which includes a mixing section and a charging throat section, said chamber having a head end and an open discharge end disposed opposite one another comprising the steps of;

(a) preforming a plurality of mixing blade segments, each having a leg portion and a discharge lip portion projecting laterally from one end thereof, (b) welding said leg portion of said mixing blade to the inner wall of said chamber with said mixing blade segments arranged in an end-to-end spiral configuration extending from adjacent said head end to adjacent said open discharge end with the discharge lip of each segment directed toward said discharge end, and thereafter (c) welding a mixing lip to said one end of said leg portion, said mixing lip projecting laterally from said leg portion and extending along at least a major portion of said mixing section of said mixing chamber, inwardly from said charging throat.

* * * * *